United States Patent [19]

Savenije

[11] Patent Number: 4,793,450

[45] Date of Patent: Dec. 27, 1988

[54] LOCKABLE PISTON-CYLINDER ASSEMBLY

[75] Inventor: Franciscus G. Savenije, Schalkhaar, Netherlands

[73] Assignee: Auping B. V., Netherlands

[21] Appl. No.: 73,832

[22] Filed: Jul. 15, 1987

Related U.S. Application Data

[63] Continuation-in-part of Ser. No. 860,488, May 7, 1986, abandoned.

[30] Foreign Application Priority Data

May 9, 1985 [NL] Netherlands ..... 8501334

[51] Int. Cl.[4] ..... F16F 9/34

[52] U.S. Cl. ..... 188/300; 267/64.12

[58] Field of Search ..... 188/285, 286, 299, 300, 188/322.11, 322.13, 322.15; 267/64.12

[56] References Cited

U.S. PATENT DOCUMENTS 2,453,855 11/1948 Oliver ..... 188/300
2,630,887 3/1953 Paquin ..... 188/300
3,322,393 5/1967 Neilson et al. ..... 267/64.12 X
3,563,349 2/1971 Spieth et al. ..... 188/300
3,828,651 8/1974 Dorner et al. ..... 188/300 X

FOREIGN PATENT DOCUMENTS 3322796 1/1985 Fed. Rep. of Germany .
2083404 12/1971 France .
7115283 11/1971 Netherlands .

*Primary Examiner*—Duane A. Reger
*Attorney, Agent, or Firm*—Leydig, Voit & Mayer

[57] ABSTRACT

Lockable piston-cylinder assembly to be mounted between two parts being movable relative to each other such as a frame and top or foot end of a bed structure. The two chambers resulting from the division of the cylinder in a piston are interconnected by a hollow piston rod provided with openings. At least one of these openings can be closed by valve member arranged in said piston rod and so fluid communication between these chambers is controlled. Valve member is actuatable from one end of the piston rod outside cylinder. For obviating undesired pressure build up in space or for controlling the pressure in this space a connection is provided to the exterior of cylinder.

20 Claims, 2 Drawing Sheets

LOCKABLE PISTON-CYLINDER ASSEMBLY

This application is a continuation-in-part of application Ser. No. 860,488 filed May 7, 1986 now abandoned.

The invention relates to a lockable piston-cylinder assembly to be mounted between two parts being movable relative to each other, such as a frame and top or foot end of a bed structure, comprising a cylinder being divided into chambers by a reciprocable piston connected to a hollow piston rod, said two chambers being fillable with a substantially non-compressible fluid, said hollow piston rod comprising at least two openings for interconnection of said chambers, disposed on either side of said piston, at least one of said openings being closable by a valve member arranged in said piston rod and controlling the connection between said chambers, said valve member being on one end actuatable from an end of said piston rod outside the cylinder.

Such a lockable piston-cylinder assembly is known from DE-A-332.279.6. As a valve member a slidable body is used sealingly engaging the piston bore. By moving the body, relative to said openings connection between these openings can be obtained or prevented, by which the lockable assembly is free and locked respectively. For moving the valve member a pin acts on the body, said pin extends into the exterior of the piston cylinder assembly through a bore in the piston rod. The other end of the piston rod ends freely in a space. This means that the pressure in this space acts on one side of the valve body. Because of this movement of the valve member is affected by the pressure in this space which can be considerable and is not constant. This is a limitation making the valve member more difficult to displace which means that actuating mechanism used for this displacement will require a corresponding considerable operating force.

The invention aims to obviate these problems.

This object is realized by a lockable piston-cylinder assembly as described above characterized in that the space in which the other end of the valve member is movable, is in fluid communication with the exterior of the cylinder.

By providing fluid communication of this space with the exterior of the cylinder, conditions prevailing inside the cylinder do not affect the operations of the valve member. It is possible to connect the space with the free atmosphere. It is also possible to connect this space with pressurizing means such as pneumatic or hydraulic controlling means.

According to a preferred embodiment of the invention the connection between the space on the other end of the valve member and the exterior of the cylinder comprises a bore through the valve member connecting said space with the bore in the piston rod. By having a bore through the valve member the piston rod needs only to project to one end of the cylinder and no further passages through the cylinder requiring sealing means are necessary.

For returning the valve member a spring can be provided in the space. The valve member can comprise a slidable body sealingly engaging the walls of the cavity in the piston within which the valve member is located. This body can be controlled by a pin arranged in the piston bore.

According to a further preferred embodiment in which the piston rod only at one place projects from the cylinder and being closed at the other end, near the other end of the cylinder a further piston member is provided in the cylinder and the chamber defined between the further piston member and the bottom of the cylinder is fillable with a gas. In this way a gas filled lockable spring is obtained.

According to a further preferred embodiment in which the valve member comprises a slidable body sealingly engaging the walls of the cavity in the piston within which the valve member is located at least one sealing sleeve is provided to the slidable member to be moved between the at least two openings wherein the diameter of the cavity of the piston rod intermediate the two openings exceeds that of the sealing sleeve to enable liquid to flow along the sealing sleeve in the free position of the assembly.

The invention will now be described with reference to preferred embodiments illustrated in the drawings in which:

FIG. 3 illustrates a third embodiment of the present invention.

Figure 1:
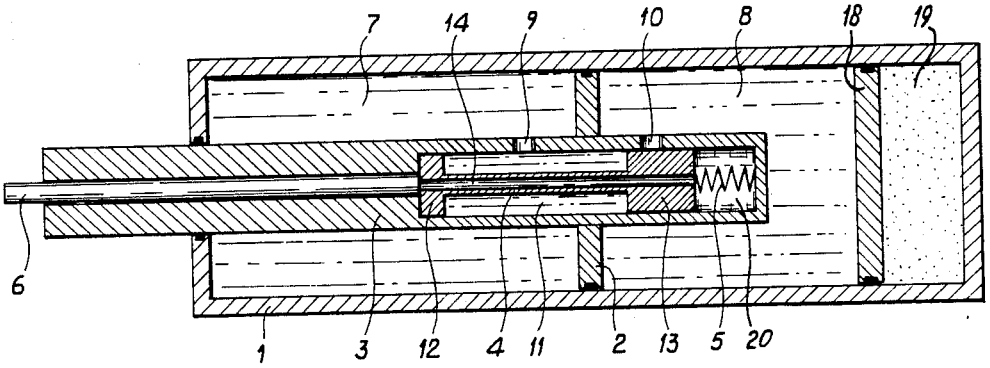
FIG. 1 shows in cross-section a lockable piston-cylinder assembly according to a first embodiment of the invention.

The lockable piston-cylinder assembly shown in FIG. 1 comprises a cylinder 1, which is divided by a free piston 18 in a chamber 19 filled with gas and part 7, 8 filled with liquid. Piston 2 separates chambers 7, 8 and is connected to the hollow piston rod 3. In said piston rod an axial slidable valve member 4 is provided. This valve member is biased in its closed position with spring 5 and can be opened against this biasing force by a pin 6 in hollow piston rod 3 acting on valve member 4. Both chambers 7 and 8 are interconnected through holes or openings 9 and 10 extending from cavity 11 in the hollow piston rod to chambers 7, 8, respectively.

On valve member 4 two piston heads 12 and 13 are spaced from each other, comprising faces in regard to each other. The piston heads guide the valve member sealingly in hollow piston rod 3. Head 13 is embodied as a slidable valve, closing in its closed position opening 10. Through openings 9 liquids can enter the cavity in the piston rod 3. In valve member 4 a bore 14 is included which provides fluid communication between the space 20 in which the spring 5 is provided and the exterior of the cylinder through the hollow piston bore. When the pin 6 acts on the valve member 4 the latter is moved against the pressure of spring 5 to expose opening 10. Because of bore 14 no pressure build up in chamber 20 will result. This pressure build up or influence of liquid present in chamber 8 when piston rod 3 is open ended, will occur with devices according to the prior art as described above. When the surface area of both piston heads equals hydrostatic forces acting on these surfaces a balance exists such that valve member 4 is only influenced by spring 5 and pin 6. Furthermore piston head 13 acting as a valve member can be arranged between openings 9, 10. In this case in the bore in which the head 13 is displaceable a recess is provided such that in one position liquid can flow around the piston head through the recess and in an other position this flow is prevented (not shown). Bore 14 can be connected with the atmosphere through hollow piston rod 3. However, it is also possible to connect bore 14 with hydraulic or pneumatic controlling means through this hollow piston rod 3 as shown in FIG. 3.

Operation of the embodiment illustrated in FIG. 1 occurs as follows. Cylinder 1 and piston rod 3 may be connected to any two components or members of a device which are movable with respect to one another and which one may desire to vary locked positions with respect to one another. Thus, piston rod 3 may be connected to the frame of a bed assembly while cylinder 1 is joined to the head of the bed assembly which is tiltable relative to the frame. In the position shown in FIG. 1, the piston 2 and cylinder 1 are in a locked position since piston head 13 blocks opening 10 in the wall of the piston rod 3 which opening when unobstructed provides fluid communication between chamber 8 and cavity 11. Therefore, the incompressible fluid in chambers 7 and 8 cannot flow between these chambers through cavity 11 and openings 9 and 10. When it is desirable to adjust the positions of the members attached to piston rod 3 and cylinder 1, the pin 6 is moved inwardly, forcing valve member 4 against the force of spring 5. When the axial slidable valve member 4 has been moved sufficiently such that piston head 13 no longer blocks fluid flow through opening 10, fluid communication is established between chambers 7 and 8 through openings 9, 10 and the cavity 11. Thus, piston 2 and hollow piston rod 3 may be moved inwardly or outwardly within chambers 7 and 8, relative to cylinder 1. When it is desired to lock the position between piston rod 3 and cylinder 1, pin 6 is retracted, i.e., released, and the valve member 4 returns to its original position under the influence of spring 5. Since chamber 20 is in communication with the atmosphere external to the piston-cylinder unit of the present invention through the bore 14 in the slidable valve member and a space between the pin 6 and the bore in the piston rod which communicates with the cavity 11, movement of valve member 4 is unaffected by the pressure in chambers 7, 8. In addition, communication between space 20 and the atmosphere external to the piston-cylinder unit also means that the valve member 4 does not need to overcome resistance to movement in the axial direction caused by an incompressible fluid in space 20. The resistance to axial movement is determined largely by the biasing force of spring 5.

To obtain a resilient effect, the piston-cylinder unit may be provided with a sliding piston 18 located at the closed end of the cylinder 1, opposite the end from which hollow piston rod 3 projects. Piston 18 defines a chamber 19 between the end of the cylinder and the piston 18 which is filled with a gaseous fluid.

Figure 2:
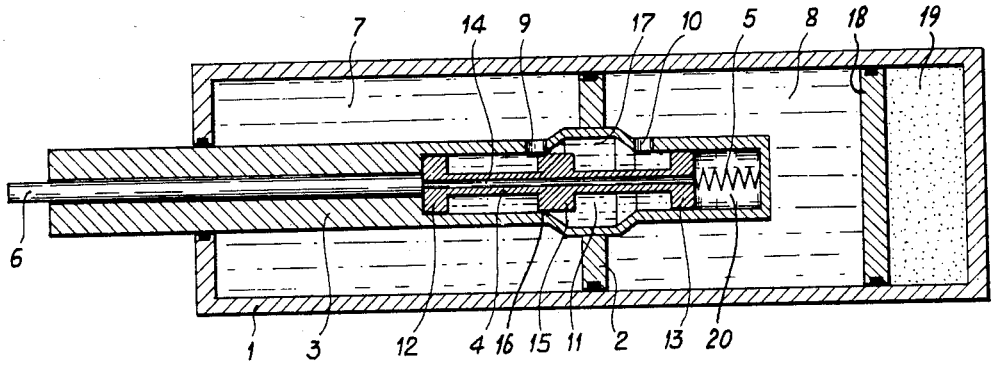
FIG. 2 shows a second embodiment in cross-section.
Figure 2:
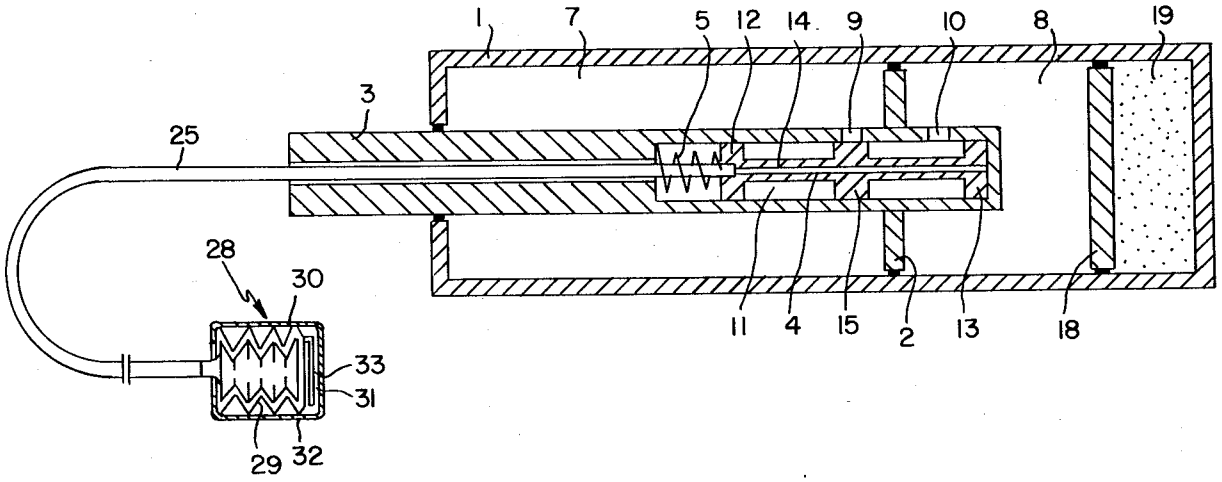

In the embodiment of the lockable assembly shown in FIG. 2 between piston heads 12, 13 a further head 15 is provided. Furthermore, the bore in the piston between openings 9 and 10 is enlarged in diameter.

In an open position chambers 7 and 8 are connected with each other because liquid can flow through openings 9 and 10 and around piston head 15 through a large area 17. In a closed condition with the same surface area of faced surfaces of two piston heads, hydraulic forces acting on the valve member compensate each other. In this embodiment because of fluid communication between space 20 and the atmosphere only pin 6 and spring 5 acts on valve member 6. In case space 20 is connected with hydraulic or pneumatic controlling means further influencing of valve member 15 can be provided.

FIG. 3 illustrates an additional embodiment of the present invention. In this embodiment, spring 5 contacts at one of its ends one of the walls which defines cavity 11 in the hollow piston rod 3 and at its other end a face of piston head 12. A flexible conduit, such as a hose or tubing 25 replaces pin 6 shown in the embodiments illustrated in FIGS. 1 and 2. As with pin 6, the external diameter of the tubing 25 is smaller than the diameter of the bore in the hollow piston rod 3 through which it passes. This permits communication between the atmosphere external to the cylinder 1 through the bore in piston rod 3 to the portion of the cavity occupied by spring 5. The flexible conduit 25 is sealingly secured and in fluid communication with, such as by insertion into, the bore 14 in the slidable valve member 4. The other end of the flexible conduit 25 is in fluid communication with a hydraulic or pneumatic means, such as an actuation member 28.

The particular actuation member 28, illustrated in FIG. 3, is a bellows device including bellows 29, cap 32, and spring 33. Cap 32 is provided with a projection 31 which is engageable in opening 30 of bellows 29.

The embodiment of FIG. 3 operates as follows. As with the devices illustrated in FIGS. 1 and 2, the piston-cylinder device is locked in position when one of the openings 9 or 10 is blocked by a head of the valve member 4 so that no fluid may pass between chambers 7 and 8 through cavity 11. Thus, the embodiment illustrated in FIG. 3 is in a locked position, as shown, since head 15 blocks opening 9. However, by compressing the bellows of actuation member 28, in which opening 30 is closed and pressure in bellows 29 is increased, fluid is forced through conduit 25 and bore 14 into space 20 (not shown in FIG. 3) at the end of cavity 11 opposite the end of piston rod 13 which projects from cylinder 1. This causes head 13, which sealingly engages the walls of the cavity 11, to move away from the closed end of cavity 11 causing the slidable valve member to move to the left and compressing spring 5. In so doing, head 15 no longer blocks opening 9 and provides fluid communication between openings 9 and 10. In this position, cylinder 1 and piston 2 may be adjusted with respect to one another. Upon release of the actuation member 28, valve member 4 will move to the right resulting in the device being locked in place.

Although the described embodiments are preferred at the time being it has to be understood that many modifications can be implemented without leaving the spirit and scope of the invention.

I claim:

1. Lockable piston-cylinder assembly adapted to be mounted between two parts being movable relative to each other, comprising a cylinder being divided into two chambers by a reciprocable piston connected to a hollow piston rod having a cavity and a bore extending between said cavity and an end of said piston rod projecting from said cylinder, said two chambers being fillable with a substantially non-compressible fluid, said cavity having at least two openings disposed on either side of said piston for fluid communication between said chambers, at least one of said openings being closable by a valve member arranged in said cavity of said piston rod and controlling fluid communication between said chambers, said valve member being on one end actuatable from said end of said piston rod projecting from said cylinder, said cavity including a space in which the other end of the valve member is movable, said space being in fluid communication with the exterior of the cylinder.

2. Lockable assembly according to claim 1, wherein fluid communication between the space on the other end of the valve member and the exterior of the cylinder is provided by a bore through said valve member which communicates said space with the bore in the piston rod.

3. Lockable assembly according to claim 1 wherein a spring is provided in said space, said spring acting on said valve member.

4. Lockable assembly according to claim 2 wherein said valve member comprises a slidable body sealingly engaging walls defining the cavity.

5. Lockable assembly according to claim 4, wherein a pin is provided in the piston rod bore for controlling said valve.

6. Lockable assembly according to claim 1 wherein said space is connected to pneumatic or hydraulic controlling means.

7. Lockable assembly according to claim 1 wherein only one end of the piston rod projects from the cylinder, said cylinder being closed at the other end, and further that near said other end a further piston member is provided in the cylinder and in that the chamber defined between said further piston member and said other end of the cylinder is fillable with a gas.

8. Lockable assembly according to claim 4 wherein said slidable body comprises at least a sealing sleeve, movable between said at least two openings and the diameter of at least a portion of the cavity of the piston rod intermediate said two openings at least at one spot exceeds that of said sealing sleeve to enable liquid to flow along the sealing sleeve in the free position of the assembly.

9. Lockable assembly according to claim 2 wherein a spring is provided in said space, said spring acting on said valve member.

10. Lockable assembly according to claim 3 wherein said valve member comprises a slidable body sealingly engaging the piston bore.

11. Lockable assembly according to claim 2 wherein said space is connected to pneumatic or hydraulic controlling means.

12. Lockable assembly according to claim 3 wherein said space is connected to pneumatic or hydraulic controlling means.

13. Lockable assembly according to claim 4 wherein said space is connected to pneumatic or hydraulic controlling means.

14. Lockable assembly according to claim 5 wherein said space is connected to pneumatic or hydraulic controlling means.

15. Lockable assembly according to claim 2 wherein only one end of the piston rod projects from the cylinder, said cylinder being closed at the other end, and further that near said other end a further piston member is provided in the cylinder and in that the chamber defined between said further piston member and said other end of the cylinder is fillable with a gas.

16. Lockable assembly according to claim 3 wherein only one end of the piston rod projects from the cylinder, said cylinder being closed at the other end, and further that near said other end a further piston member is provided in the cylinder and in that the chamber defined between said further piston member and said other end of the cylinder is fillable with a gas.

17. Lockable assembly according to claim 4 wherein only one end of the piston rod projects from the cylinder, said cylinder being closed at the other end, and further that near said other end a further piston member is provided in the cylinder and in that the chamber defined between said further piston member and said other end of the cylinder is fillable with a gas.

18. Lockable assembly according to claim 5 wherein said slidable body comprises at least a sealing sleeve, movable between said at least two openings and the diameter of at least a portion of the cavity of the piston rod intermediate said two openings at least at one spot exceeds that of said sealing sleeve to enable liquid to flow along the sealing sleeve in the free position of the assembly.

19. Lockable assembly according to claim 6 wherein said slidable body comprises at least a sealing sleeve, movable between said at least two openings and the diameter of at least a portion of the cavity of the piston rod intermediate said two openings at least at one spot exceeds that of said sealing sleeve to enable liquid to flow along the sealing sleeve in the free position of the assembly.

20. Lockable assembly accordign to claim 7 wherein said slidable body comprises at least a sealing sleeve, movable between said at least two openings and the diameter of at least a portion of the cavity of the piston rod intermediate said two openings at least at one spot exceeds that of said sealing sleeve to enable liquid to flow along the sealing sleeve in the free position of the assembly.

* * * * *